US007642891B2

(12) United States Patent
Einzinger et al.

(10) Patent No.: US 7,642,891 B2
(45) Date of Patent: Jan. 5, 2010

(54) PLANAR INDUCTANCE

(75) Inventors: Josef Einzinger, Georgensgmuend (DE); Andreas Loth, Neu-Ulm (DE)

(73) Assignee: ST-Ericsson SA, Geneva (CH)

( * ) Notice: Subject to any disclaimer, the term of this patent is extended or adjusted under 35 U.S.C. 154(b) by 216 days.

(21) Appl. No.: 10/521,854

(22) PCT Filed: Jul. 16, 2003

(86) PCT No.: PCT/IB03/03227

§ 371 (c)(1),
(2), (4) Date: Jan. 21, 2005

(87) PCT Pub. No.: WO2004/012213

PCT Pub. Date: Feb. 5, 2004

(65) Prior Publication Data

US 2005/0237144 A1 Oct. 27, 2005

(30) Foreign Application Priority Data

Jul. 25, 2002 (DE) ..... 102 33 980

(51) Int. Cl.
*H01F 27/28* (2006.01)

(52) U.S. Cl. ..... 336/226

(58) Field of Classification Search ..... 336/65, 336/183, 200, 225–226, 232, 83
See application file for complete search history.

(56) References Cited

U.S. PATENT DOCUMENTS

| | | | | |
|---|---|---|---|---|
| 2,471,777 | A * | 5/1949 | Reinartz | 140/71 R |
| 4,201,965 | A * | 5/1980 | Onyshkevych | 336/180 |
| 4,246,446 | A * | 1/1981 | Yoshida et al. | 369/136 |
| 5,068,612 | A * | 11/1991 | Auslander et al. | 324/327 |
| 5,245,307 | A | 9/1993 | Klaus et al. | |
| 5,572,179 | A * | 11/1996 | Ito et al. | 336/200 |
| 7,151,430 | B2 * | 12/2006 | Mattsson | 336/200 |

FOREIGN PATENT DOCUMENTS

JP 06053044 A * 2/1994

* cited by examiner

*Primary Examiner*—Tuyen Nguyen
(74) *Attorney, Agent, or Firm*—Eric M. Ringer; Seed IP Law Group PLLC

(57) ABSTRACT

A planar inductance, such as for monolithic HF oscillators, has planar spiral windings, each with two loops, where each winding is in the form of an "eight" with cross-conductors carrying current in the same direction and running between two loops.

21 Claims, 3 Drawing Sheets

PLANAR INDUCTANCE

The invention relates to a planar inductance, in particular for monolithic HF oscillators with planar spiral windings.

Normally, in the planar inductances known hitherto, the windings are in the form of essentially closed loops, e.g. any polygons that can assume an elliptical form in the boundary area, or may also be circular in shape, wherein, for connection of the power supply lines, the intersecting winding ends form conductor sections running, in sections, in parallel with each other and carrying current in the same direction. The disadvantage of these known structures consists in the fact that a strong magnetic field component evolves outside the winding loop. In the case of integrated circuits, such as transceiver ICs in mobile communications or in data transmission technology, which comprise further magnetic elements internally or in the external wiring, including parasitic elements if applicable—as is the case in interface circuits for LNAs, for example—interfering couplings may occur with a spiral inductance of this kind. In its turn, this may express itself in undesired oscillations, excessively high crosstalk of the relevant frequency components or similar.

It is therefore an object of the invention to create a planar inductance which, with a structure of similar simplicity to the planar inductances known hitherto, has a reduced magnetic field component outside the windings.

To achieve this object, the invention provides that each winding is in the form of an "eight" with three cross-conductors carrying current in the same direction and running between two loops.

Thanks to the design in accordance with the invention, in which each spiral winding comprises two loops, one of which carries current clockwise and the other counterclockwise, the surface requirement is similar to that for the known structures, and roughly identical inductance and performance factor values arise. The opposing magnetic flow directions in the two loops of the winding ensure that the greater part of the magnetic flow concentrates around the three central cross-conductors. The magnetic dipoles of the mutual windings lead to a good local positioning of the magnetic field components. Outside the windings, therefore, the field is considerably reduced in comparison with the structures used hitherto. Measurement results of a self-mixing effect between a fully integrated RF-VCO and a high-frequency receiving circuit, brought about by these magnetic field components, indicate a reduction of around 10 dB for the new structure as compared with the one used hitherto. Finally, it is also within the scope of the invention that the cross-conductors are located parallel with each other, and the top and bottom ones are joined to the power supply lines on opposite sides. These cross-conductors may also be located one above the other.

The planar inductance in accordance with the invention may, of course, also be in the form of multiple windings. To this end, in an embodiment of the invention, each eye of the winding may be equipped with multiple windings, arranged spirally inside one another, the inner ends of which are joined together.

To compensate the magnetic field of the supply lines, it may further be provided that the eye of the winding from which the supply lines depart is arranged to be smaller than the other eye, wherein, to this end, an additional metallization plane may be provided, if appropriate, and the central conductors are, in part, located one above the other.

The invention will be further described with reference to examples of embodiments shown in the drawings, to which, however, the invention is not restricted.

Figure 1:
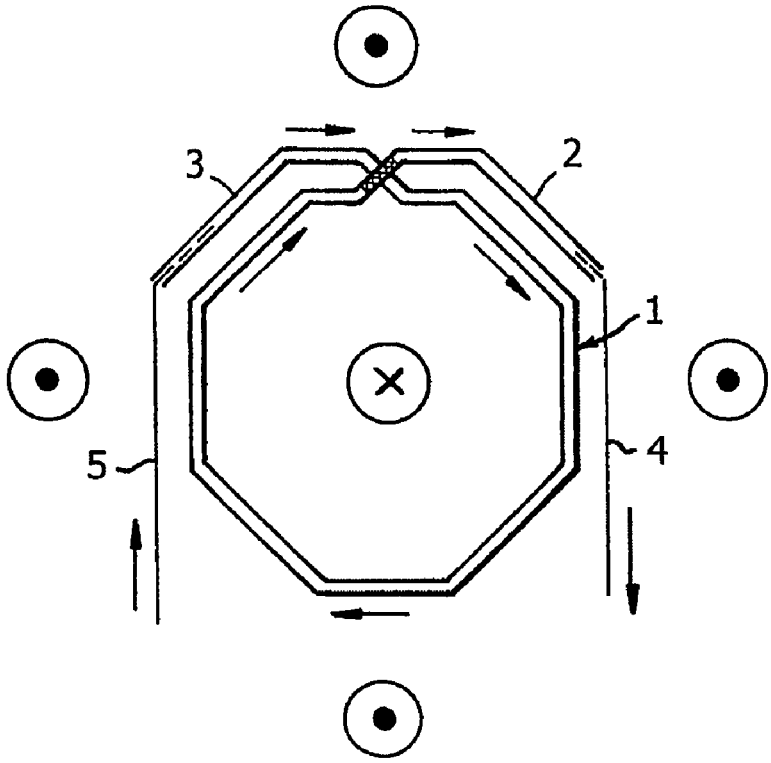
FIG. 1 shows a representation of a typical planar inductance in accordance with the prior art.

The winding for a planar inductance in accordance with the prior art as shown in FIG. 1 comprises a ring-shaped loop 1, the ends 2 and 3 of which, crossing over each other, are routed outwards and joined to the power supply lines 4 and 5, or to further loops in the case of multiple windings. As a result of the current flow, indicated by arrows, a strong magnetic field is created outside of the actual winding 1, which—as explained in detail above—has an interfering effect in many application instances.

Figure 2:
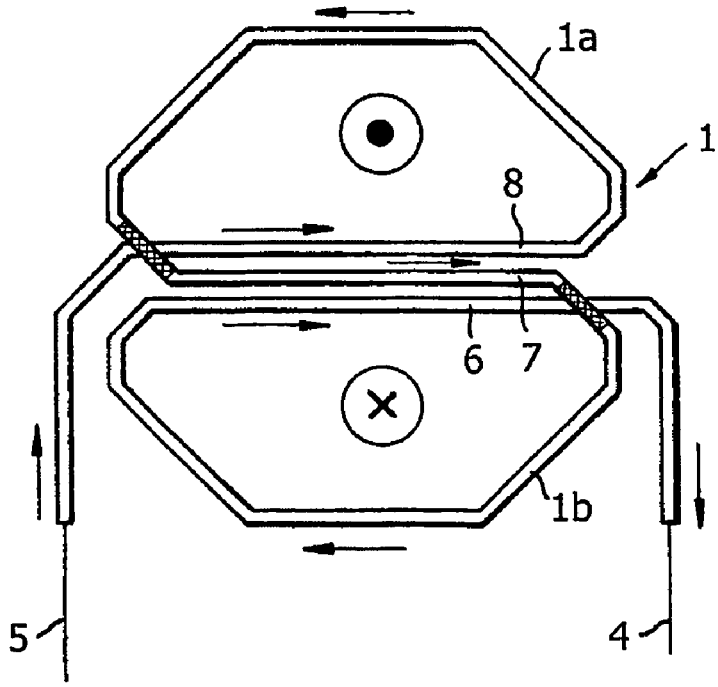
FIG. 2 shows a representation of the structure of a planar inductance in accordance with the invention.

In accordance with the invention, therefore, a modified structure is depicted, as shown in FIG. 2, with its winding 1 in the form of a figure "8" with two loops 1*a* and 1*b*, wherein three cross-conductors 6 to 8, carrying current in the same direction, are formed between the two loops 1*a* and 1*b*. These cross-conductors 6 to 8 are located parallel with each other, wherein the top cross-conductor 8 and the bottom cross-conductor 6 are joined on opposite sides to the power supply lines 4 and 5. It hereby goes without saying that crossovers of the planar spiral windings are, of course, insulated.

The magnetic dipoles of the opposed-direction winding loops 1*a* and 1*b* give rise to an extremely good local positioning of the magnetic field components, so that virtually no appreciable magnetic field components any longer occur outside of the winding loops.

Figure 3:
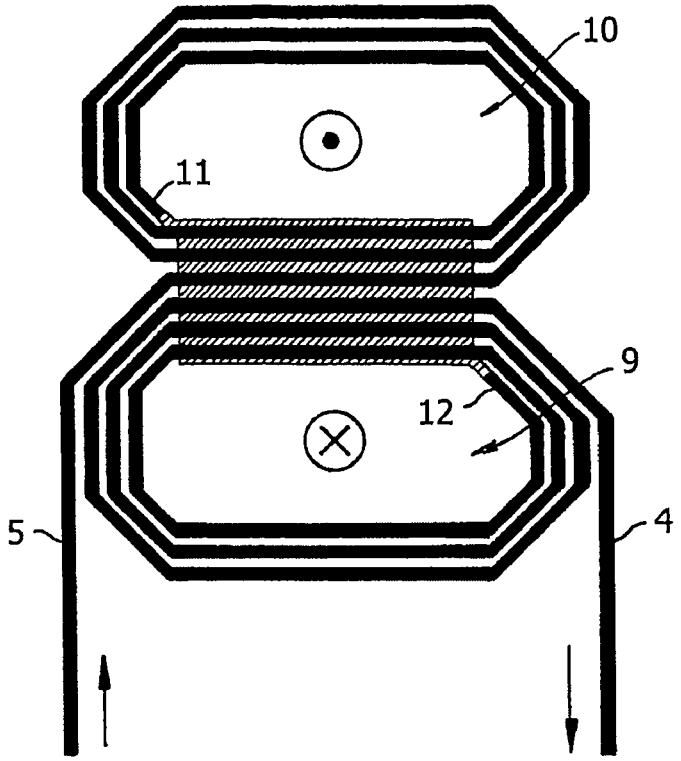
FIGS. 3 to 5 show examples of embodiments of a planar inductance with multiple windings.

FIG. 3 shows an example of embodiment of a planar inductance with multiple windings. Here, the conductor layout is arranged in such a way that, starting from supply line 5 of the bottom eye 9, the top eye 10 is firstly wound in such a way that the conductor tracks are arranged spirally inside each other. The end 11 of the inner winding of the top eye 10 is joined to the end 12 of the inner winding of the bottom eye 9.

Figure 4:
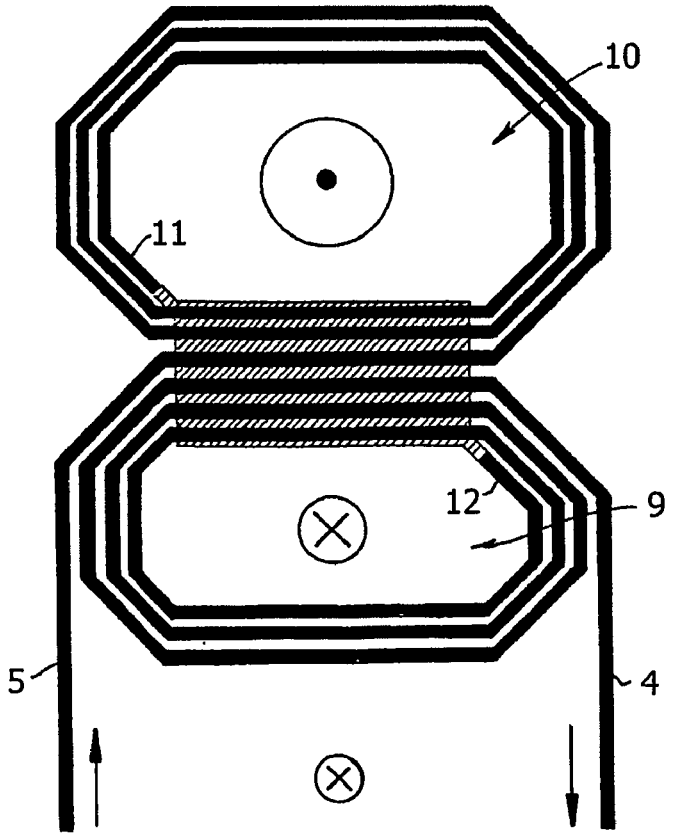

To compensate the magnetic field of supply lines 4 and 5, in the example of embodiment shown in FIG. 4, the top eye 10 of the planar inductance is arranged to be larger.

Figure 5:
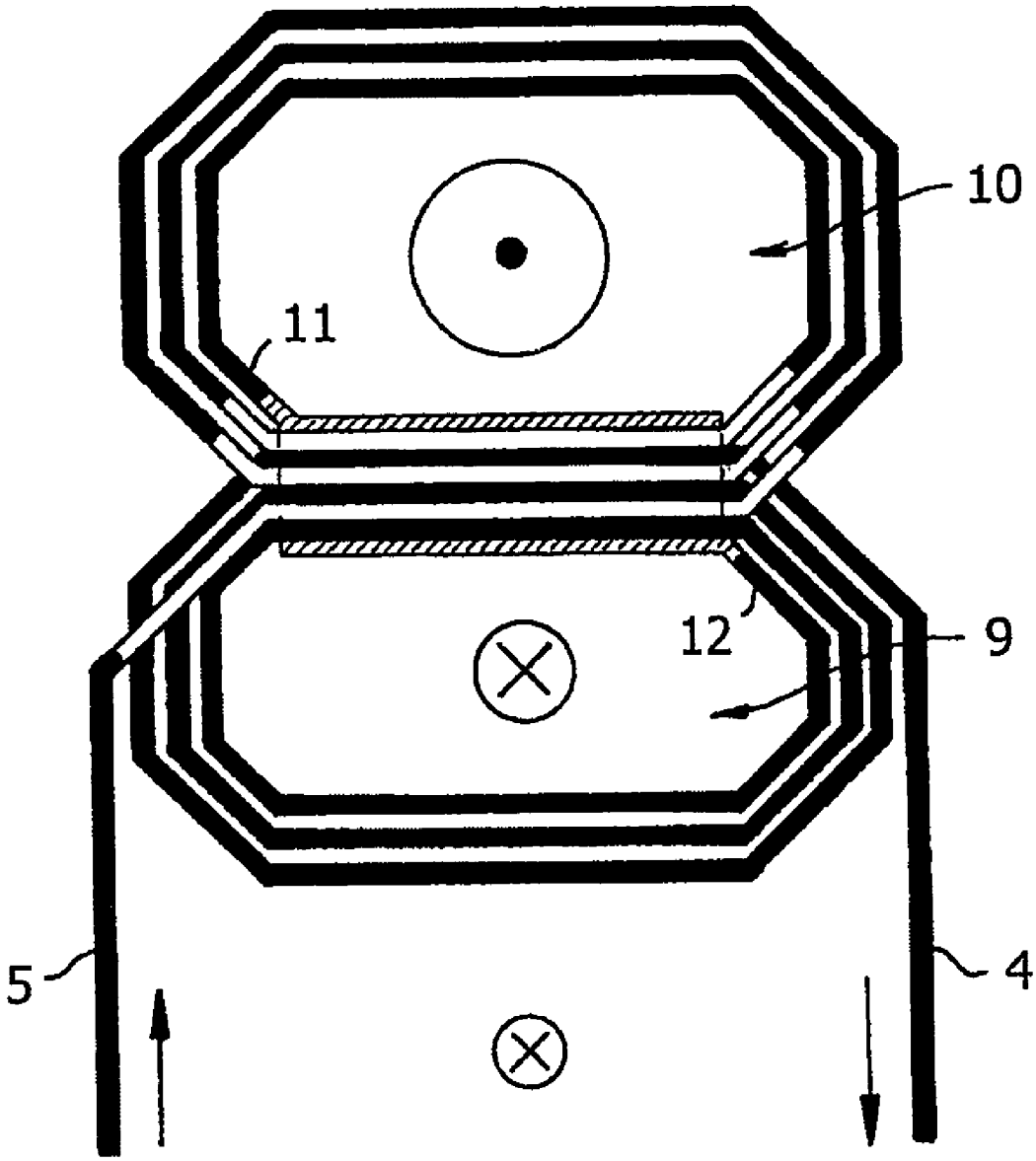

In the embodiment example shown in FIG. 5, in which the top eye 10, i.e. the eye without supply lines 4 and 5, is again arranged to be larger, this is achieved in that an additional metallization plane is provided, and the central conductors are, in part, located one above the other.

The invention claimed is:

1. An inductor comprising:

a winding having a first loop and a second loop having oppositely directed windings and a cross-conduction area therebetween having a unidirectional current path; and a pair of power supply lines extending along opposite sides of the second loop , a first power supply line of said pair of power supply lines connected to the first loop and a second power supply line of said pair of power supply lines connected to the second loop.

2. The inductor of claim 1, wherein the current path in the cross-conduction area from the first loop to the second loop comprises a plurality of current paths substantially parallel to each other.

3. The inductor of claim 1, wherein the first loop and the second loop are on a single plane.

4. The inductor of claim 1, wherein the power supply lines extend away from the cross-conduction area between the first loop and the second loop, and the power supply lines are arranged along opposite sides of the second loop in a substantially perpendicular direction to the cross-conduction area.

5. The inductor of claim 1, further comprising cross conductors between the first and the second loop, said cross conductors being confitured to carry current in the same direction.

6. The inductor of claim 1, wherein the cross conductors are substantially parallel to each other.

7. The inductor of claim 1, wherein the first loop and the second loop are configured to carry current in opposite directions.

8. The inductor of claim 1, wherein the first loop and the second loop are configured to form an "eight" shape, with the cross-conduction area therebetween.

9. The inductor of claim 1, wherein a magnetic field of the first loop and a magnetic field of the second loop have no appreciable magnetic field components outside of the respective loops.

10. An inductor comprising:

a winding having a first loop and a second loop and having a cross-conduction area having a unidirectional current path, the first loop and the second loop having oppositely directed current paths, the cross-conduction area connecting the first loop and the second loop and crossing a portion of the first loop and a portion of the second loop, wherein the crossed portion of the first loop and the crossed portion of the second loop are approximately at opposite sides of the cross-conduction area; and a pair of power supply lines extending along opposite sides of the second loop, a first power supply line of said pair of power supply lines connected to the first loop and a second power supply line of said pair of power supply lines connected to the second loop.

11. The inductor of claim 10 wherein the unidirectional current path in the cross-conduction area from the first loop to the second loop comprises a plurality of current paths substantially parallel to each other.

12. The inductor of claim 10 wherein the first loop and the second loop are on a single plane.

13. The inductor of claim 1 wherein the power supply lines extend away from the cross-conduction area between the first loop and the second loop, and the power supply lines are arranged along opposite sides of the second loop in a substantially perpendicular direction to the cross-conduction area.

14. The inductor of claim 10, wherein the first loop and the second loop are configured to form an "eight" shape, with the cross-conduction area therebetween.

15. The inductor of claim 10 wherein a magnetic field of the first loop and a magnetic field of the second loop have no appreciable magnetic field components outside of the respective loops.

16. An inductor comprising:

a first non-circular winding having a first current path in a first direction and a second non-circular winding having a second current path in a second direction opposite the first direction, the first winding and the second non-linear windings having respective left hand and right hand sides, each one of the first and the second non-circular windings have a respective first generally linear section extending between the respective left hand and right hand sides, the first generally linear sections are arranged generally parallel and proximal to each other;

a first power supply line connected to a left hand end of the first generally linear section of the first non-circular winding and extending along the left hand of the second winding;

a second power supply line connected to a right hand end of the first generally linear section of the second non-circular winding and extending along the right hand side of the second winding; and a single crossover-conductor crossing a left hand side portion of the first non-circular winding and crossing right hand side portion of the second non-circular winding, the single crossover-conductor electrically connecting a left hand end of a conductor track of the first non-circular winding to a right hand conductor track of the second non-circular winding.

17. The inductor of claim 16 wherein the single crossover-conductor includes a generally linear section that is generally parallel to the generally linear sections of the first and the second non-circular windings.

18. The inductor of claim 17 wherein the generally linear section of the single crossover-conductor is disposed between the respective first generally parallel sections of the first and the second non-circular winding.

19. The inductor of claim 16 wherein the first non-circular winding and the second first non-circular windings have a respective second generally linear section, the second generally linear sections are arranged generally parallel to the first generally linear sections.

20. The inductor of claim 19 wherein the second generally linear sections are arranged on opposite sides of the single crossover-conductor.

21. The inductor of claim 16 wherein the first non-circular winding and the first non-circular winding are on a single plane.

* * * * *

UNITED STATES PATENT AND TRADEMARK OFFICE

CERTIFICATE OF CORRECTION

PATENT NO. : 7,642,891 B2
APPLICATION NO. : 10/521854
DATED : January 5, 2010
INVENTOR(S) : Einzinger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 534 days.

Signed and Sealed this

Sixteenth Day of November, 2010

David J. Kappos

David J. Kappos
*Director of the United States Patent and Trademark Office*